US006317022B2

(12) United States Patent
Doi

(10) Patent No.: US 6,317,022 B2
(45) Date of Patent: Nov. 13, 2001

(54) VARIABLE RESISTOR

(75) Inventor: Takeshi Doi, Fukui-ken (JP)

(73) Assignee: Murata Manufacturing Co, Ltd., Kyoto (JP)

( * ) Notice: Subject to any disclaimer, the term of this patent is extended or adjusted under 35 U.S.C. 154(b) by 0 days.

(21) Appl. No.: 09/727,008

(22) Filed: Nov. 30, 2000

(30) Foreign Application Priority Data

Nov. 30, 1999 (JP) ..... 11-339482

(51) Int. Cl.[7] ..... H01C 10/32

(52) U.S. Cl. ..... 338/162; 338/163; 338/166; 338/174

(58) Field of Search ..... 338/162, 163, 338/174, 175, 166

(56) References Cited

U.S. PATENT DOCUMENTS

| | | | | |
|---|---|---|---|---|
| Re. 33,627 | * | 7/1991 | Nishizawa et al. | 338/162 |
| 4,429,297 | * | 1/1984 | Nakatsu | 338/162 |
| 4,785,277 | * | 11/1988 | Yashiro | 338/162 |
| 5,053,741 | * | 10/1991 | Ueda | 338/160 |
| 5,059,940 | * | 10/1991 | Thomas, Jr. | 338/174 |
| 5,500,634 | * | 3/1996 | Ueda | 338/174 |
| 5,525,956 | * | 6/1996 | Hashizume et al. | 338/322 |
| 5,592,141 | * | 1/1997 | Aldave | 338/162 |
| 5,790,012 | * | 8/1998 | Nakatsu et al. | 338/152 |
| 5,982,272 | * | 11/1999 | Masuda | 338/162 |
| 6,037,855 | * | 3/2000 | Honma | 338/160 |

FOREIGN PATENT DOCUMENTS

09/223608 8/1997 (JP) .

* cited by examiner

*Primary Examiner*—Karl D. Easthom
(74) *Attorney, Agent, or Firm*—Keating & Bennett, LLP

(57) ABSTRACT

A variable resistor is constructed to prevent bending strain from spreading to the conductive portions to a resistor when bending is executed with respect to the external connection portions of metallic terminals. The variable resistor provides a low-profile variable resistor capable of stabilizing the electrical connection between the metallic terminals and the resistor. This variable resistor includes metallic terminals insert-molded in a board, and a slider sliding on the resistor disposed on the board. The slider is rotatably installed on the board by caulking the grommet disposed on a first metallic terminal,and the conductive portions of second metallic terminals are conductive to the resistor. Each of the external connection portions is extended out of the bottom of the board, and is folded upwardly at the position of the corresponding notch. Thereby, bending stress is minimized, the looseness of the metallic terminals with respect to the board is prevented, and the reliability of the connection between the resistor and the conducting portions is increased.

18 Claims, 5 Drawing Sheets

VARIABLE RESISTOR

BACKGROUND OF THE INVENTION

1. Field of the Invention

The present invention relates to a low-profile and small-sized variable resistor, and more particularly, to the structure of the external connection portion of a metallic terminal that is insert-molded in a board.

2. Description of the Related Art

As a known example of a variable resistor, Japanese Unexamined Patent Application Publication No. 9-223608 discloses a variable resistor wherein a first metallic terminal having a grommet is insert-molded in a board, second metallic terminals are also insert-molded in the board. A substantially arcuate resistor conductive to the second metallic terminal is provided on the top surface of the board. A slider having a drawn portion with a hole provided at the center thereof is fitted to the grommet of the first metallic terminal. The grommet is caulked in a outwardly opened state, and thereby the slider is rotatably installed on the board to be being electrically connected with the first metallic terminal. A contact arm portion sliding on the resistor, and an adjusting portion rotationally operated with a tool such as a driver, are integrally provided with the slider.

In the above-described variable resistor, since the external connection portions of the first and second metallic terminals are constructed to be led out of the bottom of the board, and folded upwardly toward the top surface side, the product can be made low-profile, and soldering of the external connection portions to the board is facilitated.

When bending is performed with respect to the external connection portions of the metallic terminals, bending stresses are concentrated on the board portions holding the external connection portions. However, once the external connection portions of the metallic terminals are led out along the bottom of the board as described above, the terminal holding power of the board is reduced, such that the metallic terminals generate looseness. In particular, since one end portion of each of the second metallic terminals is exposed on the top surface of the board, and this exposed portion is electrically connected with the resistor provided on the top surface of the board, the occurrence of the loose metallic terminals causes an unstable electrical connection between the metallic terminals and the resistor, and deteriorates the characteristics of this variable resistor.

SUMMARY OF THE INVENTION

To overcome the above described problems, preferred embodiments of the present invention prevent bending strain from spreading from the conductive portions to a resistor when bending is executed with respect to the external connection portions of the metallic terminals, and provide a low-profile variable resistor capable of stabilizing the electrical connections between the metallic terminals and the resistor.

A first preferred embodiment of the present invention provides a variable resistor including a board in which a first metallic terminal is insert-molded, on the top surface of which a substantially arcuate resistor is provided, and in which second metallic terminals having conductive portions conductive to the resistor are insert-molded, and a slider having a contact arm portion sliding on the resistor and having an adjustable portion rotationally operated with a tool, the slider being rotatably attached on the board in a state of being electrically connected with the first metallic terminal. In this variable resistor, external connection portions led out of the bottom of the board are integrally provided with the first and second metallic terminals and a notch is provided at a portion of each of the external connection portions, the portion being adjacent to the board, and the external connection portions are each folded upwardly at the positions of the notches, along the corresponding sides of the board.

When folding the external connection portions of the metallic terminals upwardly, bending stresses act on the metallic terminals, and the board is subjected to a load caused by the stress. However, since the external connection portions each have notches previously provided therein, they can be folded without imposing a substantial load on the board. This prevents the loosening of the metallic terminals from occurring, and allows the electrical connection between the metallic terminals and the resistor to be stabilized. At the same time, the electric connection between the first metallic terminal and the slider is also stabilized.

Since the external connection portions of the first and second metallic terminals are led out of the bottom of the board, the product is low-profile. Also, since the external connection portions of the metallic terminals are each folded upwardly along the corresponding sides of the board, fillets are each provided between the external connection portions and the printed circuit board when the variable resistor is soldered to the printed circuit board, and thereby an outstanding solder connection is easily achieved.

As in the above-described conventional example, when folding external connection portions of the metallic terminals each having no notches at right angles, the outer peripheral surfaces thereof is expanded, such that cracks occur on the plated surfaces of the terminals, and the wettability of solder is susceptible to deterioration. On the other hand, as in various preferred embodiments of the present invention, when folding each of the external connection portions of the metallic terminals at the position of a notch provided therein, the expansion amount of the outer peripheral surface of each of the external connection portions is greatly reduced, and the occurrence of cracks on the plated surface thereof is prevented.

Preferably, a gap having a space is provided in which no capillary effect of the soldering flux occurs between each of the folded portions of the first and second metallic terminals and the corresponding side of the board. In general, when decreasing the height of the variable resistor, there is the possibility that soldering flux intrudes into each of the gaps between the metallic terminals and the printed circuit board during the soldering of the variable resistor to the board, and that the flux is sucked up by the capillarity with the result that the flux adheres to the printed surface of the resistor. As a consequence, the electrical connection between the resistor and the slider is unstable, and the characteristics of the variable resistor are prone to deteriorate.

In contrast to this, in accordance with a second preferred embodiment of the present invention, the possibility of flux adhering to the printed surface of the resistor is eliminated, by setting the above-described gap to a dimension such that no capillary effect of soldering flux occurs. Meanwhile, in various preferred embodiments of the present invention, since each of the bending positions of the external connection portions is defined by a notch, the distance between each of the folded portions and the corresponding side of the board is set to a constant value.

Other features, characteristics, elements and advantages of the present invention will become apparent from the following description of preferred embodiments thereof with reference to the attached drawings.

DETAILED DESCRIPTION OF PREFERRED EMBODIMENTS

Figure 1:
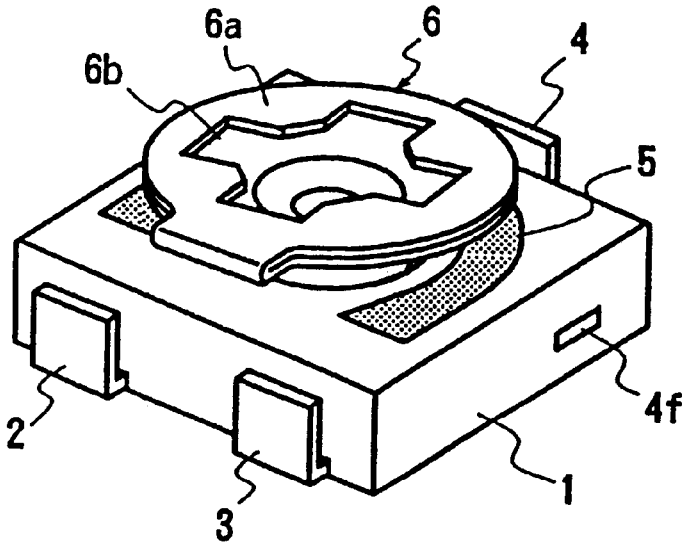
FIG. 1 is a perspective view showing the assembling state of an example of a variable resistor in accordance with preferred embodiments of the present invention.
Figure 2:
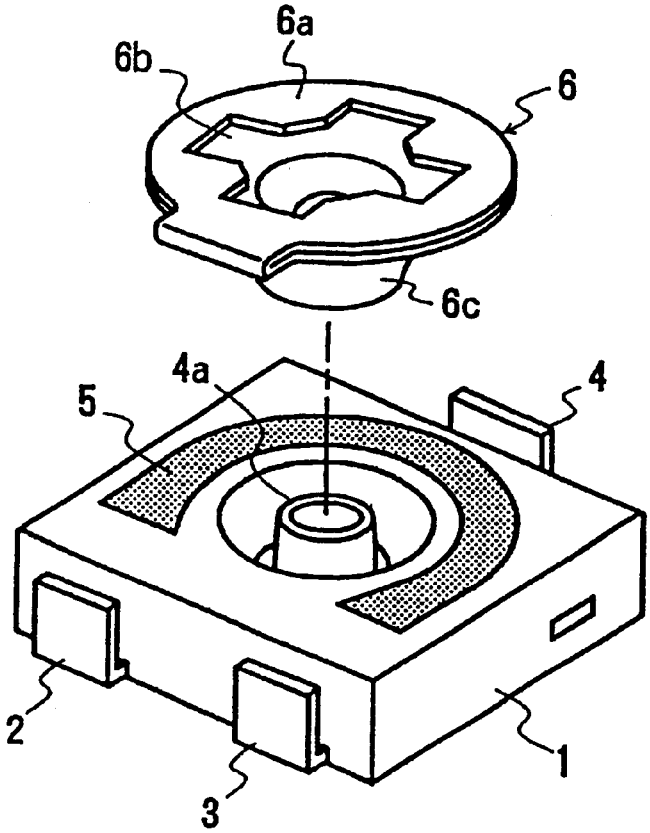
FIG. 2 is a exploded perspective view showing the variable resistor in FIG. 1.
Figure 3:
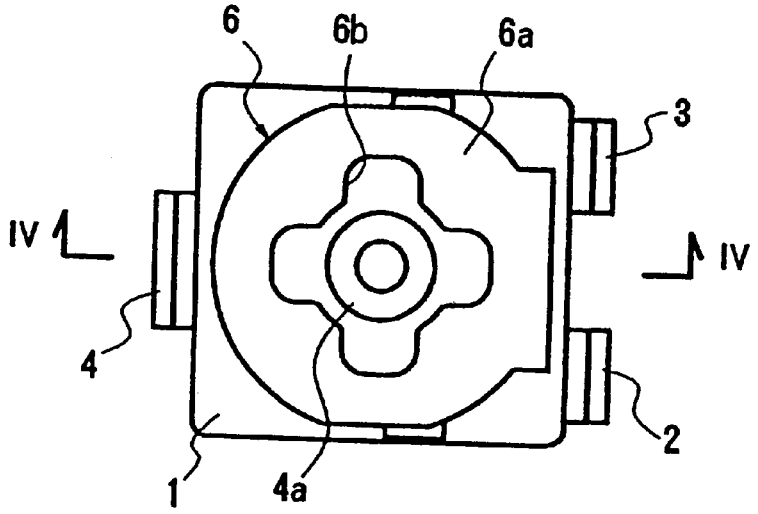
FIG. 3 is a plan view showing the variable resistor in FIG. 1.
Figure 4:
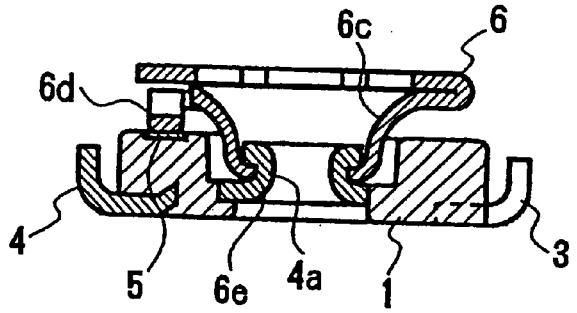
FIG. 4 is a sectional view taken along the line IV—IV in FIG. 3.
Figure 5:
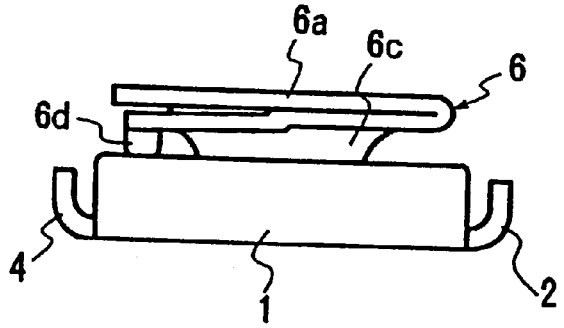
FIG. 5 is a side view showing the variable resistor in FIG. 1.
Figure 6:
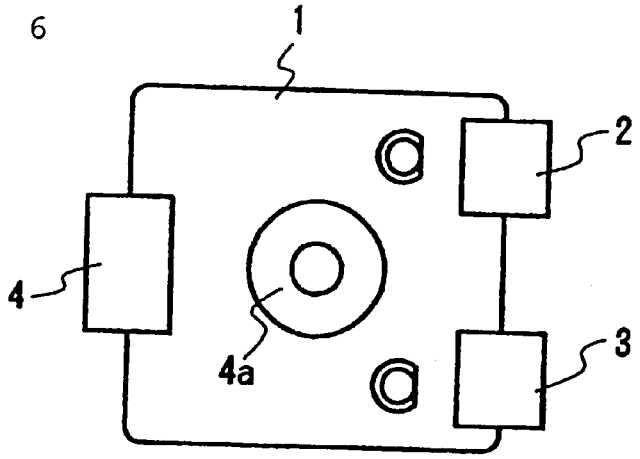
FIG. 6 is a bottom plan view showing the variable resistor in FIG. 1.

FIGS. 1 through 9 show an example of a variable resistor in accordance with preferred embodiments of the present invention.

The variable resistor includes a board 1 having metallic terminals 2 and 3 which are second metallic terminals, and a variable-side metallic terminal 4 which is a first metallic terminal integrally insert-molded therein, and a slider 6 provided on the variable-side metallic terminal 4 using caulk.

As a material for the board 1, a heat-resistant resin or a thermosetting resin is used to be resistant to the heat during soldering and to enable a stable operation under a high temperature atmosphere. For example, liquid crystal (LCP) resin, denatured 6T nylon, polyphenylene sulfide (PPS) resin, polyester-based resin, epoxy resin, or diaryl phthalate or other suitable material is preferably used.

Figure 9A:
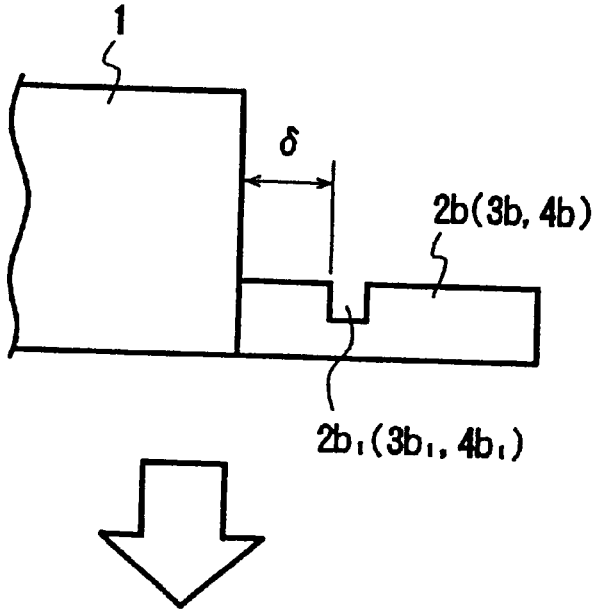
FIGS. 9A and 9B are enlarged side views illustrating an external connection portion of the metallic terminal before and after bending.
Figure 9B:
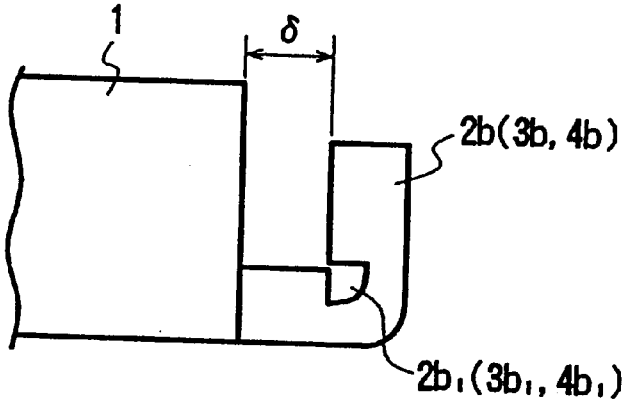

On the top surface of the board 1, the conductive portions 2*a* and 3*a* of the fixed-side terminals 2 and 3 are exposed. The external connection portions 2*b*, 3*b*, and 4*b* constituting soldering portions of the fixed-side terminals 2 and 3 and the variable-side terminal 4 with respect to the printed circuit board, are each led out of the bottom of the board 1, and are each folded upwardly at approximate right angles along sides of the board 1. In particular, as shown in FIG. 9, on the top surfaces of the external connection portions 2*b*, 3*b*, and 4*b*, notches $2b_1$, $3b_1$, and $4b_1$ are provided, respectively, at the positions at a distance δ from the respective sides of the board 1. By folding the external connection portions 2*b*, 3*b*, and 4*b* at the positions of the notches thereof, a gap δ having a space in which no capillary effect of the soldering flux occurs, is provided between each of the folded portions of the external connection portions 2*b*, 3*b*, and 4*b* and the corresponding side of the board.

On the tip side at the front of the conductive portions 2*a* and 3*a* of the fixed-side terminals 2 and 3, first anchor portions 2*c* and 3*c* which are folded downwardly, are provided, respectively. On the intermediate portion between the conductive portions 2*a* and 3*a* and the external connection portions 2*b* and 3*b*, second anchor portions 2*d* and 3*d* which are folded upwardly, are provided (see FIG. 7). These anchor portions 2*c*, 3*c*, 2*d*, and 3*d* are embedded in the board 1, and prevent the fixed-side terminals 2 and 3 from becoming loose (see FIG. 8). On the top surface of the board 1, a resistor 5 including carbon or other suitable materials is provided by applying it in a substantially arcuate shape so as to cover the conductive portions 2*a* and 3*a* of the fixed-side terminals 2 and 3, and by printing it. Thereby, the fixed-side terminals 2 and 3, and the resistor 5 become electrically conductive to each other. At one end of the variable-side terminal 4, a grommet 4*a* is integrally disposed therewith, and is exposed from the central hole 1*a* of the board 1. A relief hole 4*c* is provided between the grommet of the variable-side terminal 4 and the external connection portion 4*b*, in order to inhibit the spreading of a strain when bending is performed with respect to the external connection portion 4*b*.

The fixed-side terminals 2 and 3, and the variable-side terminal 4 are preferably constructed of a thin plate having good electrical conductivity, such as copper alloy or stainless steel. To improve solder wettability, it is desirable to perform surface treatment, such as precious metal plating using gold or silver, solder plating, or tin plating with respect to at least the external connection portions 2*b*, 3*b*, and 4*b*.

The slider 6 is preferably constructed of a metal having good electrical conductivity and spring characteristics, and is configured out of a thin plate of e.g. copper alloy, stainless steel, or precious metal-based alloy or other suitable material. With respect to abase metal among these materials, the execution of the surface treatment with a precious metal such as gold or silver stabilizes sliding characteristics and contact characteristics. The thickness of surface-treated film is preferably about 0.01 μm to about 2 μm. Use of a cladding material also exerts a similar effect as the surface treatment. The slider 6 includes an annular top surface 6*a*, and a cup-like drawn portion 6*c* folded from the outer edge portion of the top surface 6*a* to the bottom surface side thereof. In the top surface 6*a*, a cross-like engaging groove (adjustment portion) 6*b* rotationally operated by a tool such as a driver, is provided. A semi-arcuate contact arm portion 6*d* is provided on the outer peripheral edge of the drawn portion 6*c*, the outer peripheral edge being opposed to the folded portion. This contact arm portion 6*d* is adapted to elastically contact the above-described resistor 5, and to slide thereon. A fitting hole 6*e* for fitting to the grommet 4*a* of the variable-side terminal 4, is provided at the approximate center of the drawn portion 6*c*. By fitting this fitting hole 6*e* to the grommet 4*a* of the variable-side terminal 4, and by caulking the grommet 4*a* in an outwardly opened state, the slider is rotatably installed on the board 1.

Figure 7:
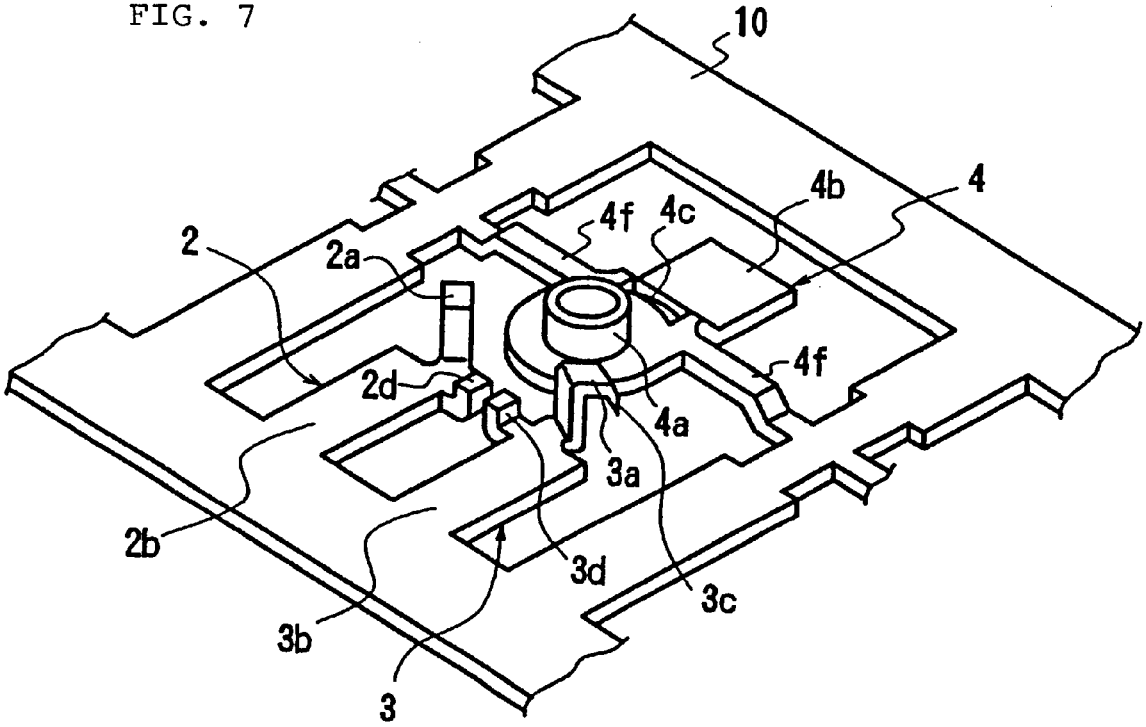
FIG. 7 is a perspective view illustrating a lead frame obtained by stamping out, in a coupled state, the fixing-side and variable-side metallic terminals used for a variable resistor in FIG. 1.

FIG. 7 shows a lead frame 10 formed of one metallic plate by performing pressing with respect to the fixed-side terminals 2 and 3 and the variable-side terminal 4.

The fixed-side terminals 2 and 3 are connected with the lead frame 10 via the external connection portions 2*b* and 3*b*, and the variable-side terminal 4 are connected with the lead frame 10 via narrow supporting portions 4*f*. These supporting portions 4*f* are used for holding the position of the variable-side terminal 4 during insert-molding, and are cut off at the product stage thereof.

Figure 8:
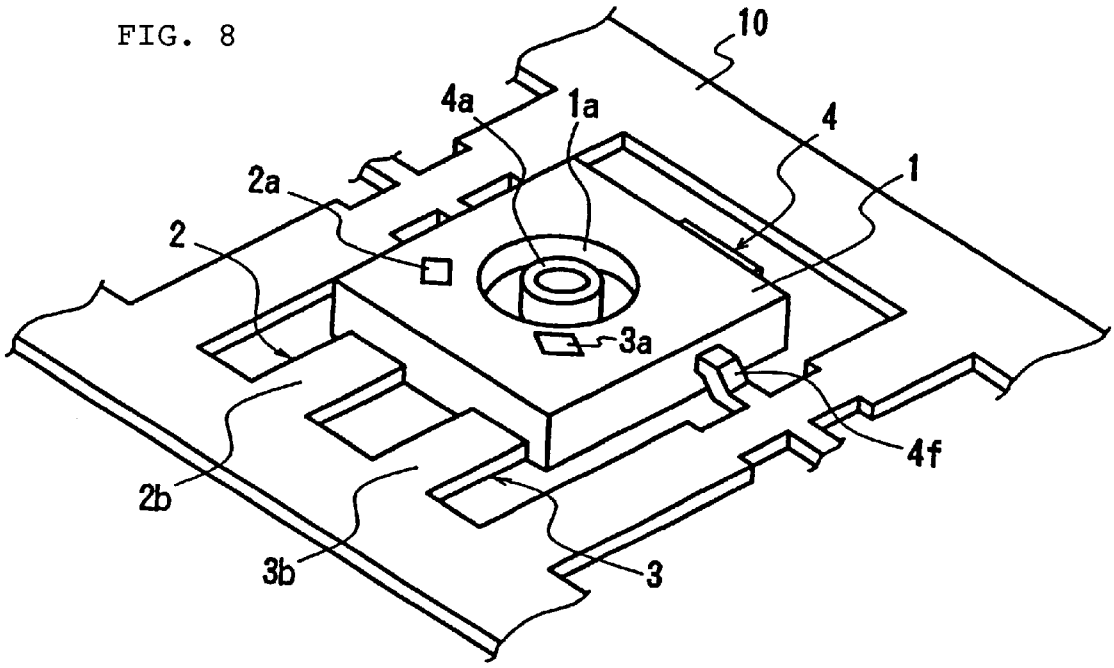
FIG. 8 is a perspective view illustrating a lead frame in FIG. 7, on which a board has been molded.

FIG. 8 illustrates the above-described lead frame 10 where the board 1 is molded.

As is evident from the figure, the grommet 4*a* of the variable-side terminal 4 is exposed from the approximately central hole 1*a* of the board 1, and the conductive portions 2*a* and 3*a* of the fixed-side terminals 2 and 3 are exposed on the top surface of the board 1.

The external connection portions 2*b* and 3*b*, and the supporting portions 4*f* are cut from the frame 10 where the board 1 is molded as shown in FIG. 8, and the external connection portions 2*b*, 3*b*, and 4*b* of the fixed-side terminals 2 and 3, and the variable-side terminal 4 are each folded upwardly along the respective sides of the board 1. At this time, there is the possibility that large bending stresses act on the base portions of the external connection portions 2*b*, 3*b*, and 4*b* protruding from the board 1. However, since the external connection portions 2*b*, 3*b*, and 4*b* have respective notches $2b_1$, $3b_1$, and $4b_1$, provided therein, the bending stresses are greatly reduced, such that the influence of the bending stresses on the fixing strength of the terminals 2 to 4 with respect to the board 1 becomes negligible. This implies that the terminals 2 to 4 are prevented from generating looseness, and that the electrical connection between the conductive portions 2*a* and 3*a* of the fixed-side terminals 2 and 3, and the resistor 5 is stabilized.

Also, in this preferred embodiment, since the anchor portions 2*c*, 3*c*, 2*d*, and 3*d* are provided at the fixed-side terminals 2 and 3, they are engaged in the board 1, and thereby the looseness of the fixed-side terminals 2 and 3 due to bending stresses is substantially avoided. This ensures excellent conductivity between the conductive portions 2*a* and 3*a* of the fixed-side terminals 2 and 3, and the resistor 5.

Furthermore, when bending is performed with respect to the external connection portion 4*b* of the variable-side terminal 4, there is also a bending stress which tends to cause the variable-side terminal 4 to generate looseness. However, since the variable-side terminal 4 also includes a notch $4b_1$, and further includes a relief hole 4*c* provided therein, into which the resin material of the board 1 enters, a bending strain of the external connection portion 4*b* is prevented from spreading to the grommet 4*a*. There is no risk, therefore, that the grommet 4*a* generates looseness when the external connection portion 4*b* is subjected to bending.

Moreover, since the external connection portions 2*b*, 3*b*, and 4*b* of the terminals 2 to 4 have respective notches $2b_1$, $3b_1$, and $4b_1$ provided therein, the outer periphery sides of the round bent portions are each prevented from expanding, and thereby the plated surfaces of the terminals are resistant to cracks. Thereby, the solder wettability of the round bent portions of the terminals is very resistant to deterioration.

Figure 10:
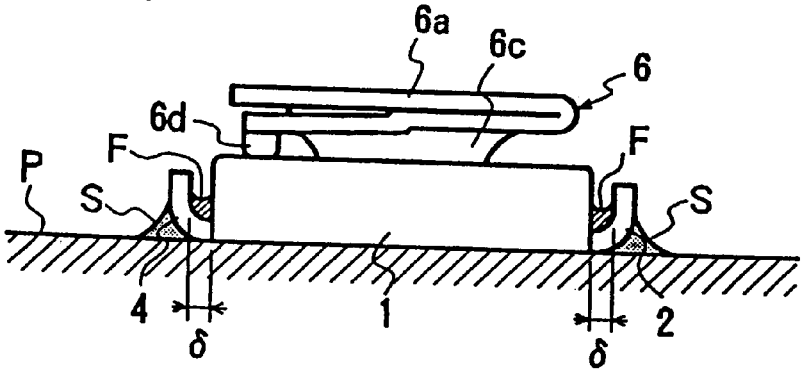
FIG. 10 is a side view illustrating the variable resistor in accordance with various preferred embodiments of the present invention, the variable resistor having been soldered onto a printed circuit board.

As shown in FIG. 10, when soldering the variable resistor to the printed circuit board P, solder fillets S are formed between the external connection portions 2*b*, 3*b*, and 4*b*, and the printed circuit board P. This provides a quality solder connection. In addition, since there is provided a gap δ having the space in which no capillary effect of the flux occurs, between each of the external connection portions 2*b*, 3*b*, and 4*b*, and the corresponding side of the board 1, the flux F accumulates within this gap δ, such that the flux is not sucked up to the top surface of the board 1. There is no risk, therefore, that the flux F adheres onto the printed surface of the resistor 5. This prevents the electrical contact between the resistor 5 and slider 6 from being unstable. Also, since the flux is thus difficult to wick up, it is possible to solder using a solder iron with which the flux amount is difficult to control.

There is a correlation between the above-described gap δ and the prevention effect thereof on the wicking-up of flux. The gap dimension δ exerts the prevention effect depends on soldering conditions to a large degree. When soldering using a usual reflow oven, for example, under the condition of a cream solder film having a thickness of about 200 μm, if the gap dimension δ is not less than about 0.1 mm, the prevention effect against the wick effect of the flux up the surface of the resistor 5 is very large. Even if the gap dimension is less than about 0.1 mm, however, a large effect is achieved depending on a soldering condition.

As is evident from the above descriptions, in accordance with the first preferred embodiment of the present invention, the external connection portions of the metallic terminals are each led out of the bottom of the board, the notches are each provided in the portions of these external connection portions adjacent to the board, and the external connection portions of the metallic terminals are each folded upwardly at the positions of these notches, along the corresponding sides of the board, such that the bending stresses of the terminals are greatly reduced, and the load imposed on the board is greatly reduced. Thereby, the looseness of the metallic terminals is substantially prevented, and the electric connection between the metallic terminals and the resistor can be stabilized.

Furthermore, since the external connection portions of the metallic terminals are led out of the bottom of the board, the profile of the product is greatly reduced. Also, since the external connection portions are each folded upwardly along the corresponding sides of the board, fillets are each formed between the external connection portions and the printed circuit board when the variable resistor is soldered to the printed circuit board, and thereby a quality soldering connection is easily made.

Moreover, since the external connection portions of the metallic terminals are each folded at the positions of the notches therein provided, the expansion amounts of the outer peripheral surface thereof are greatly reduced, and thereby the occurrence of cracks on the surface-treated surfaces such as plated surfaces is prevented.

While preferred embodiments of the present invention have been described, it is to be understood that modifications will be apparent to those skilled in the art without departing from the scope of the invention, which is to be determined solely by the following claims.

What is claimed is:

1. A variable resistor, comprising:

a board having a first metallic terminal which is insert-molded in the board, a resistor provided on a top surface of said board and which is substantially arcuate, and second metallic terminals having conductive portions conductive to said resistor which are insert-molded in said board; and a slider having a contact arm portion arranged to slide on said resistor and having an adjusting portion rotationally operatable with a tool, said slider being rotatably attached on said board such that it is electrically connected with said first metallic terminal; wherein external connection portions led out of the bottom of said board are integrally provided with said first and second metallic terminals; and a notch provided at a portion of each of said external connection portions, said portion being adjacent to said board, and said external connection portions are each folded upwardly at the positions of said notches, along the corresponding sides of said board.

2. A variable resistor as claimed in claim 1, wherein a gap having a space in which no capillary effect of the soldering flux occurs is provided between each of the folded portions of said external connection portions and the corresponding sides of said board.

3. A variable resistor as claimed in claim 1, wherein said board is a resin board which is stable at high temperatures.

4. A variable resistor as claimed in claim 1, wherein said board is made of a liquid crystal resin.

5. A variable resistor as claimed in claim 1, wherein said external connection portions include notches at positions of a distance δ from a respective side of said board.

6. A variable resistor as claimed in claim 1, further including first anchor portions folded downwardly and attached to said conductive portions.

7. A variable resistor as claimed in claim 1, wherein an intermediate portion between said conductive portions and said external connection portions includes second anchor portions which are folded upwardly.

8. A variable resistor as claimed in claim 1, wherein said first and second metallic terminals are made of a thin plate having electrical conductivity.

9. A variable resistor as claimed in claim 1, wherein said slider is made of a metal having electrical conductivity and spring characteristics.

10. A variable resistor as claimed in claim 9, wherein said slider includes a thin plate of copper alloy.

11. A variable resistor as claimed in claim 9, wherein said slider includes a thin plate of stainless steel.

12. A variable resistor as claimed in claim 1, wherein said slider includes an annular top surface and a cup-like drawn portion folded from an outer edge portion of the top surface to a bottom side thereof.

13. A variable resistor as claimed in claim 12, wherein a cross-like engaging groove is provided in said annular top surface.

14. A variable resistor as claimed in claim 12, wherein said slider further includes a semi-arcuate contact arm portion provided on an outer peripheral edge of the drawn portion, the outer peripheral edge arranged opposite to the folded portion of the drawn portion.

15. A variable resistor as claimed in claim 1, further including a lead frame defined by a metallic plate.

16. A variable resistor as claimed in claim 15, wherein said first and second metallic terminals are connected to said lead frame via external connection portions.

17. A variable resistor as claimed in claim 1, further comprising variable-side terminals.

18. A variable resistor as claimed in claim 15, further comprising variable-side terminals connected to said lead frame via narrow supporting portions.

* * * * *